US009313600B2

(12) United States Patent
Choi et al.

(10) Patent No.: US 9,313,600 B2
(45) Date of Patent: Apr. 12, 2016

(54) METHOD AND APPARATUS OF ADJUSTING DISTRIBUTION OF SPATIAL SOUND ENERGY

(75) Inventors: Jung Woo Choi, Hwaseong-si (KR); Young Tae Kim, Seongnam-si (KR); Sang Chul Ko, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1258 days.

(21) Appl. No.: 13/224,640

(22) Filed: Sep. 2, 2011

(65) Prior Publication Data

US 2012/0057732 A1 Mar. 8, 2012

(30) Foreign Application Priority Data

Sep. 2, 2010 (KR) ..... 10-2010-0085910

(51) Int. Cl.

| | |
|---|---|
| ***H04R 5/02*** | (2006.01) |
| ***H04S 7/00*** | (2006.01) |
| *H04R 3/12* | (2006.01) |
| *H04R 5/033* | (2006.01) |
| *H04R 1/40* | (2006.01) |

(52) U.S. Cl.

CPC ..... *H04S 7/303* (2013.01); *H04R 1/403* (2013.01); *H04R 3/12* (2013.01); *H04R 5/033* (2013.01); *H04R 2430/20* (2013.01); *H04S 2420/01* (2013.01); *H04S 2420/07* (2013.01)

(58) Field of Classification Search

CPC ..... H04R 5/00; H04R 5/02; H04R 5/04; H04R 5/033; H04R 3/12; H04S 2420/01; H04S 1/002; H04S 1/005; H04S 2400/01; H04S 7/301; H04S 7/302

USPC ..... 381/56, 59, 77, 79, 80, 82, 182, 387, 381/300, 303, 309, 26; 367/137, 138

See application file for complete search history.

(56) References Cited

U.S. PATENT DOCUMENTS

| | | | | |
|---|---|---|---|---|
| 8,045,722 | B2 * | 10/2011 | Choi et al. | 381/58 |
| 8,295,500 | B2 * | 10/2012 | Shin et al. | 381/59 |
| 8,454,515 | B2 * | 6/2013 | Kamiyama et al. | 600/445 |
| 9,094,752 | B2 * | 7/2015 | Choi et al. | |
| 2009/0097666 | A1 * | 4/2009 | Kim et al. | 381/59 |
| 2012/0014525 | A1 * | 1/2012 | Ko et al. | 381/17 |
| 2012/0163636 | A1 * | 6/2012 | Choi et al. | 381/182 |

FOREIGN PATENT DOCUMENTS

| | | |
|---|---|---|
| JP | 2006-13711 | 1/2006 |
| JP | 2007-300404 | 11/2007 |
| JP | 2009-17137 | 1/2009 |
| JP | 2010-28591 | 2/2010 |
| KR | 10-2008-0064622 | 7/2008 |
| KR | 10-2009-0037691 | 4/2009 |
| KR | 10-2009-0109425 | 10/2009 |

* cited by examiner

*Primary Examiner* — Xu Mei
(74) *Attorney, Agent, or Firm* — Staas & Halsey LLP

(57) ABSTRACT

Provided is a method of adjusting a distribution of spatial sound energy, including storing information associated with a sound transfer function from each of speakers of a speaker array to a position of at least one listener, and information associated with the sound transfer function from each of the speakers of the speaker array to a far-field position, and generating at least two sound beams maximizing a far-field sound pressure attenuation with respect to a source signal, based on information associated with the sound transfer function, in order to form a personal sound zone in the position of the at least one listener.

24 Claims, 11 Drawing Sheets

METHOD AND APPARATUS OF ADJUSTING DISTRIBUTION OF SPATIAL SOUND ENERGY

CROSS-REFERENCE TO RELATED APPLICATIONS

This application claims the priority benefit of Korean Patent Application No. 10-2010-0085910, filed on Sep. 2, 2010, in the Korean Intellectual Property Office, the disclosure of which is incorporated herein by reference.

BACKGROUND

1. Field

Embodiments relate to a method and apparatus for adjusting a distribution of spatial sound energy.

2. Description of the Related Art

Proposed is a personal sound zone forming technology that may transfer a sound to only a predetermined listener without creating noise for people around the predetermined listener, and without using an earphone or a headset.

SUMMARY

According to an aspect of one or more embodiments, there is provided a method of adjusting a distribution of spatial sound energy to form a personal sound zone, the method including generating, using at least one processor, at least two sound beams maximizing a far-field sound pressure attenuation with respect to a source signal, based on information associated with a sound transfer function, in order to form a personal sound zone in a position of at least one listener.

The method may further include storing information associated with the sound transfer function from each of speakers of a speaker array to the position of the at least one listener, and information associated with the sound transfer function from each of the speakers of the speaker array to a far-field position.

The generating may include generating the at least two sound beams so that beam patterns of the at least two sound beams may have a relatively high sound pressure in the position of the at least one listener compared to a surrounding position of the at least one listener.

The generating may include generating the at least two sound beams to minimize interference between beam patterns of the at least two sound beams that are focused on both ear positions of each of the at least one listener, based on information associated with the sound transfer function.

The generating of the at least two sound beams to minimize the interference may include generating the at least two sound beams by making relative phases of the at least two sound beams be different, to minimize the interference between the beam patterns of the at least two sound beams.

The method may further include acquiring an optimal phase value using the beam patterns of the at least two sound beams.

The acquiring may include assigning, to the beam patterns of the at least two sound beams, a constraint criterion for detecting the optimal phase value, acquiring a speaker excitation function minimizing a sound pressure in a far-field position, using the beam patterns assigned with the constraint criterion, and acquiring the optimal phase value using the speaker excitation function.

The constraint criterion may minimize a far-field sound pressure compared to a sound pressure in both ear positions of each of the at least one listener with respect to each of the beam patterns of the at least two sound beams.

The acquiring of the optimal phase value using the speaker excitation function may include acquiring, as the optimal phase value, a phase value having a minimum far-field sound pressure among a plurality of phase values satisfying the speaker excitation function.

According to an aspect of one or more embodiments, there is provided an apparatus for adjusting a distribution of spatial sound energy to form a personal sound zone, the apparatus including a beam generator to generate at least two sound beams maximizing a far-field sound pressure attenuation with respect to a source signal, in order to form a personal sound zone in a position of at least one listener, a convolution calculator to generate a multichannel signal by performing convolution of the at least two sound beams using at least one processor, and a speaker array unit to output the multichannel signal via a speaker array.

The apparatus may further include a transfer function database to store information associated with the sound transfer function from each of speakers of the speaker array to the position of the at least one listener, and information associated with the sound transfer function from each of the speakers of the speaker array to a far-field position.

The beam generator may include a beam pattern generator to generate beam patterns of the at least two sound beams based on information stored in the transfer function database.

The beam pattern generator may generate, based on information stored in the transfer function database, the patterns of the at least two sound beams that are focused on both ear positions of each of the at least one listener to maximize the far-field sound pressure attenuation.

The beam pattern generator may generate the at least two sound beams by making relative phases of the at least two sound beams be different, to minimize interference between the beam patterns of the at least two sound beams.

The convolution calculator may generate the multichannel signal by performing convolution of the beam patterns of the at least two sound beams in real time.

The convolution calculator may generate at least two multichannel signals by separating the source signal into a sound signal of a low frequency band and a sound source of a high frequency band based on a frequency band, by applying different beam patterns to the separated sound signals, and by performing convolution of the sound signals applied with the different beam patterns.

The convolution calculator may generate the at least two multichannel signals by mixing a sound beam of an intermediate frequency band with the sound source of the high frequency band based on a distance from the at least one listener and a frequency, and by performing convolution of the at least two sound beams.

The convolution calculator may further include a spectral equalizer to adjust a frequency distribution of at least two multichannel signals so that the at least two multichannel signals may not be separately heard in the position of the at least one listener.

The position of the at least one listener may correspond to either both ear positions of a single listener or positions of a plurality of listeners.

According to one or more embodiments, it is possible to enhance a performance of an indoor personal sound zone by preventing at least two sound beams from being reflected from a wall resulting in a decrease in the performance of the personal sound zone.

According to one or more embodiments, when at least two sound beams are generated for a single user or a plurality of users, it is possible to acquire the at least two sound beams and to prevent performance deterioration occurring due to interference between the at least two sound beams, and may quickly decrease a sound pressure in a far-field position.

According to one or more embodiments, without increasing an aperture size of a speaker array, it is possible to obtain a difference in sound pressure sufficient enough to be applied to the entire frequency bandwidth using a single array.

According to another aspect of one or more embodiments, there is provided at least one non-transitory computer readable medium storing computer readable instructions to implement methods of one or more embodiments.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
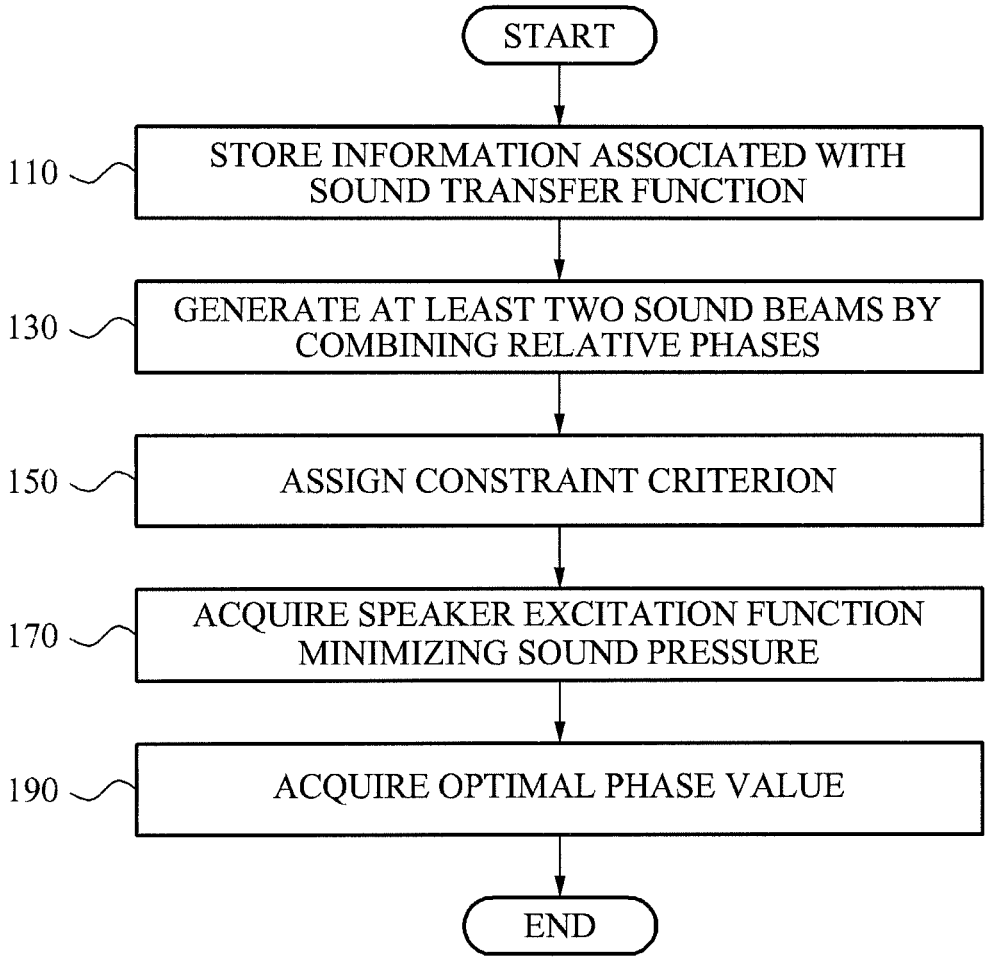
FIG. 1 illustrates a method of adjusting a distribution of spatial sound energy according to one or more embodiments.

Reference will now be made in detail to embodiments, examples of which are illustrated in the accompanying drawings, wherein like reference numerals refer to the like elements throughout. Embodiments are described below to explain the present disclosure by referring to the figures.

FIG. 1 illustrates a method of adjusting a distribution of spatial sound energy according to one or more embodiments.

Referring to FIG. 1, in operation 110, a spatial sound energy distribution adjusting apparatus may store information associated with a sound transfer function from each of speakers of a speaker array to a position of at least one listener, and information associated with the sound transfer function from each of the speakers of the speaker array to a far-field position.

The spatial sound energy distribution adjusting apparatus may generate at least two sound beams maximizing a far-field sound pressure attenuation with respect to a source signal, based on information associated with the sound transfer function. The maximizing of the far-field sound pressure attenuation is in order to form a personal sound zone in the position of the at least one listener.

Information associated with the sound transfer function used to generate the at least two sounds beams may be information associated with the sound transfer function stored in a database as described above in operation 110, or may be information associated with the sound transfer function directly input from an outside. The spatial sound energy distribution adjusting apparatus may generate the at least two sound beams so that beam patterns of the at least two sound beams may have a relatively high sound pressure in the position of the at least one listener compared to a surrounding position of the at least one listener.

The spatial sound energy distribution adjusting apparatus may generate the at least two sound beams to minimize interference between beam patterns of the at least two sound beams that are focused on both ear positions of each of the at least one listener, based on information associated with the sound transfer function.

A distance attenuation characteristic of at least two sound beams separately focused on both ear positions of each of the at least one listener will be described with reference to FIG. 2C.

In operation 130, the spatial sound energy distribution adjusting apparatus may generate the at least two sound beams by making relative phases of the at least two sound beams be different, to minimize the interference between the beam patterns of the at least two sound beams.

The interference occurring between the beam patterns of the at least two sound beams will be further described with reference to FIG. 3.

The spatial sound energy distribution adjusting apparatus may acquire an optimal phase value maximizing the far-field sound pressure attenuation, using the beam patterns of the at least two sound beams.

In operation 150, the spatial sound energy distribution adjusting apparatus may assign, to the beam patterns of the at least two sound beams, a constraint criterion for detecting the optimal phase value, in order to acquire the optimal phase value.

The constraint criterion may be based on a constrained optimization scheme, and may reduce a far-field sound pressure compared to a sound pressure in both ear positions of each of the at least one listener with respect to each of the beam patterns of the at least two sound beams.

The constrained optimization scheme will be further described with reference to FIG. 6.

In operation 170, the spatial sound energy distribution adjusting apparatus may acquire a speaker excitation function minimizing a sound pressure in a far-field position, using the beam patterns assigned with the constraint criterion.

In operation 190, the spatial sound energy distribution adjusting apparatus may acquire the optimal phase value using the speaker excitation function.

For example, the spatial sound energy distribution adjusting apparatus may acquire, as the optimal phase value, a phase value having a minimum far-field sound pressure among a plurality of phase values satisfying the speaker excitation function.

The spatial sound energy distribution adjusting apparatus according to one or more embodiments may be applicable to a variety of audio signal transmission devices, for example, a monitor, a portable music playback device, a digital TV, a PC, and the like, when a sound is desired to be played back in an indoor environment where a sound reflection occurs.

Figure 2A:
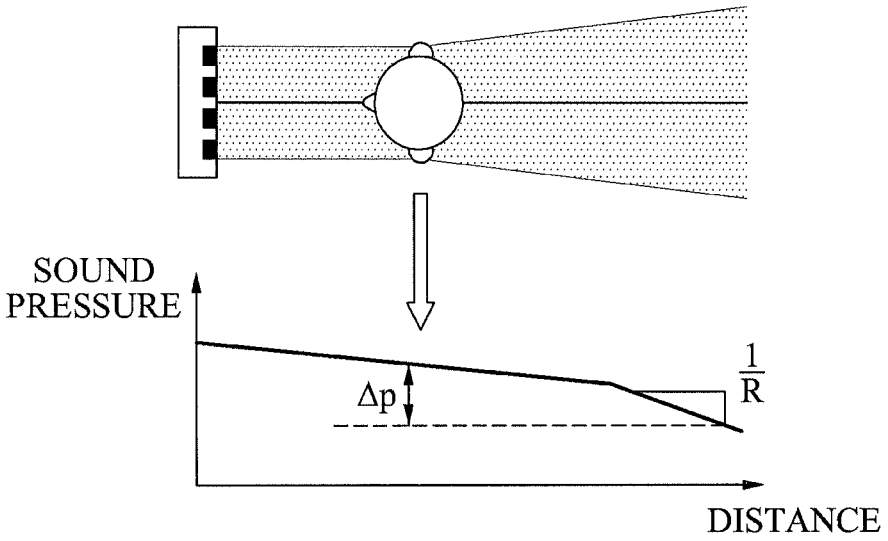
FIG. 2A (RELATED ART)
FIG. 2A through FIG. 2C illustrate a distance attenuation characteristic with respect to various sound beams.
Figure 2B:
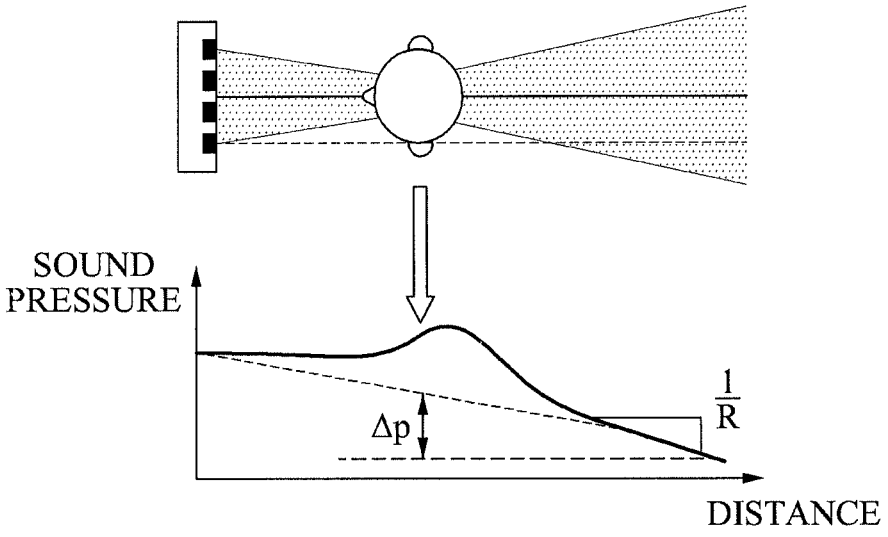
FIG. 2B (RELATED ART)

FIG. 2A illustrates a distance attenuation characteristic of a far-field sound beam, and FIG. 2B illustrates a distance attenuation characteristic when Rayleigh distance is reduced to increase a far-field sound pressure attenuation.

Figure 2C:
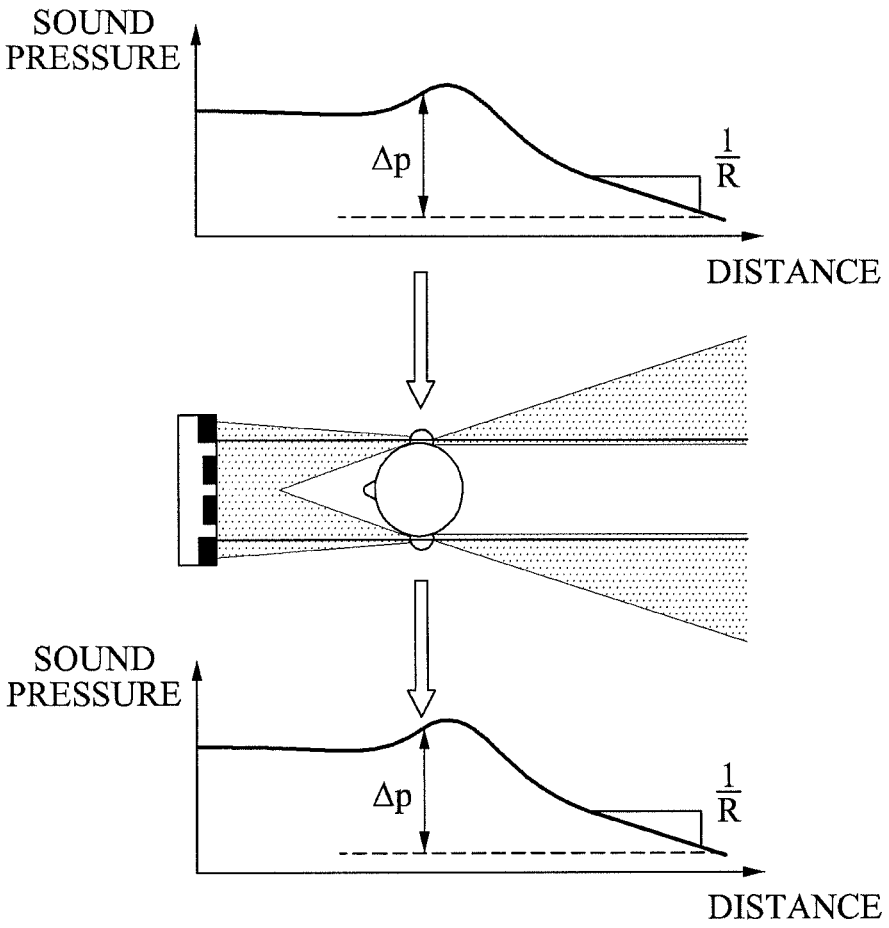

FIG. 2C illustrates a distance attenuation characteristic of at least two sound beams separately focused in both ear positions of at least one listener according to one or more embodiments.

According to one or more embodiments, when forming a personal sound zone in a listener position, a spatial sound energy distribution adjusting apparatus and method may decrease sound waves that are reflected towards a rear of a listener due to sound beams.

When forming sound beams indoors, a direct sound emitted from a speaker array and reflected waves reflected from a reflected surface, for example, an inner wall and the like may occur. The reflected waves may cause a sound to flow into an area beyond a listening area and to be heard in the area beyond the listening area, which may result in deteriorating a performance of the personal sound zone.

Accordingly, to eliminate the effect of reflected waves, there is a need to minimize the energy of sound reflected from the reflected surface by quickly decreasing the energy of sound beams spread to the rear of the listener according to a distance.

Referring to FIG. 2A, when a beam pattern is generated using a general array technology, the beam pattern may have an attenuation rate where a sound pressure is slowly attenuated based on a distance in a near field, and is simply in inverse proportion to distance R, that is, 1/R in a far field.

Even though the sound pressure attenuation rate needs to be reduced in order to further attenuate the reflection of sound beams occurring due to the reflected surface, the far-field sound pressure attenuation rate is constrained to a form of "1/R".

Accordingly, instead of changing the far-field sound pressure attenuation rate, it may be possible to reduce a distance starting to have the attenuation rate of 1/R, that is, Rayleigh distance.

The Rayleigh distance may be reduced using a method of compensating for a distance difference between a listener and each of speakers of the speaker array according to signal processing and the like.

However, in this case, a beam width may become smaller than a head size of a listener as shown in FIG. 2B. Accordingly, the sound pressure may not be maintained in both ear positions of the listener and decrease. Referring to FIG. 2B, even though the far-field sound pressure is attenuated, the sound pressure may not be maintained in the ear positions of the listener. Accordingly, a sound pressure difference Δp between the listener position and the far-field position may not be enhanced.

Referring to FIG. 2C, to obtain a sufficient far-field sound pressure attenuation while minimizing a width of sound beams in a near field, at least two sound beams separately focused on both ear positions of each of at least one listener may be generated, which is described above with reference to FIG. 1.

Here, the at least two sound beams may maximize the far-field sound pressure attenuation with respect to a source signal.

As shown in FIG. 2C, since at least two sound beams are focused on only both ear positions of a listener, each sound beam may have a relatively small Rayleigh distance, and expansion of a beam width may be restrained. Accordingly, the sound pressure attenuation may quickly appear after traveling beyond a corresponding listener position.

By directly focusing the at least two sound beams with respect to both ear positions of the listener, it is possible to acquire a relatively high sound pressure in the listener position. Accordingly, it is possible to secure a relatively high sound pressure difference Δp between the listener position and the far-field sound pressure.

As described above, when at least two sound beams are focused at close angles, interference may occur between beam patterns of the at least two sound beams and thus, a focusing performance may be deteriorated. The interference occurring when combining the at least two sound beams will be described with reference to FIGS. 3A and 3B.

Figure 3A:
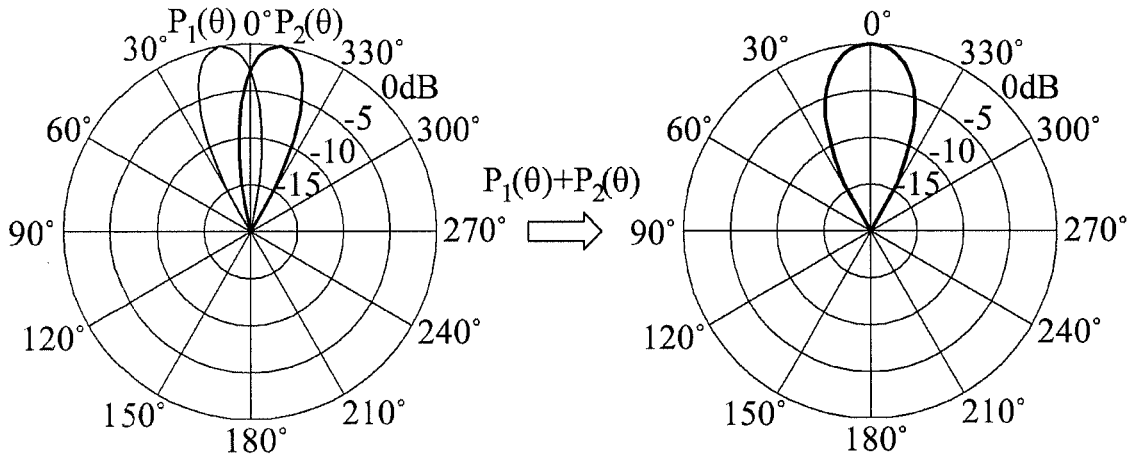
FIG. 3A illustrates a main lobe occurring when two different sound beams are combined.
Figure 3B:
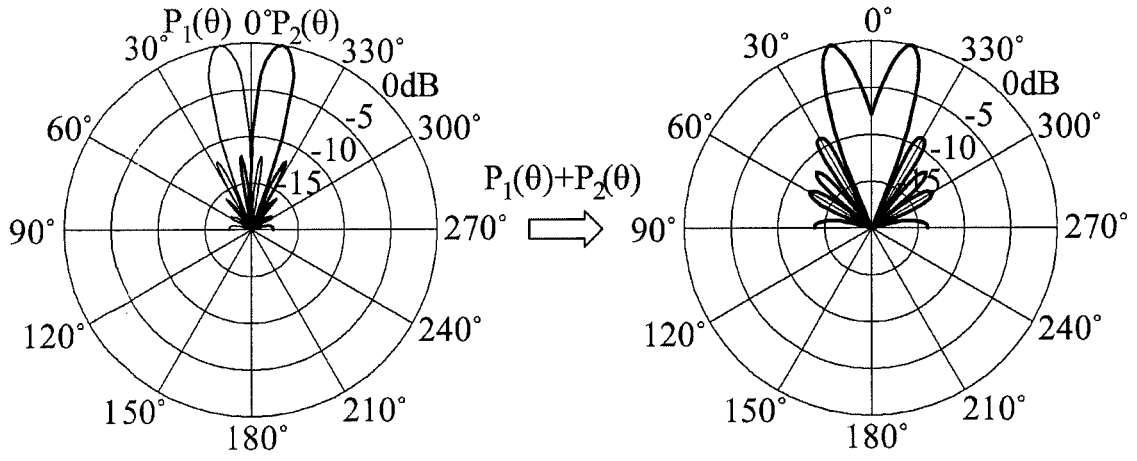
FIG. 3B illustrates a side lobe occurring when two different sound beams are combined.

FIG. 3A illustrates a main lobe occurring when two different sound beams are combined, and FIG. 3B illustrates a side lobe occurring when two different sound beams are combined.

A simple method of generating separate beams may be a method of simultaneously generating a plurality of sound beams having different directions. For example, when beam patterns of at least two sound beams are symmetrically generated, a method of initially determining a beam pattern $P_1(\theta)$ of one sound beam and generating a beam pattern $P_2(\theta)=P_1(-\theta)$ symmetrical to the beam pattern $P_1(\theta)$ and then, generating two sound beams may be used.

In the above example, when a width of the at least two sound beams is less than a head size of a listener, it is possible to sufficiently configure at least two separate sound beams by simply combining sound beams. However, when the head size is similar to the beam width, and when at least two sound beams are combined, interference may occur between the at least two sound beams.

Referring to FIG. 3A, when combining main lobes of two sound beams, two separate sound beams may not be generated and instead, the beam width may be expanded. In this case, the combined sound beams may have the expanded beam width. Accordingly, the sound pressure may not be attenuated in a far field.

Referring to FIG. 3B, interference occurs between a main lobe of a corresponding sound beam and a side lobe of an opposite beam among two different sound beams, deteriorating performance of sound beams.

When combining at least two sound beams, there may be a need to prevent the above phenomenon from occurring.

According to one or more embodiments, it is possible to minimize interference between beam patterns of at least two sound beams focused on both ear positions of a listener by generating the at least two sound beams maximizing a far-field sound pressure attenuation with respect to a source signal.

According to one or more embodiments, it is possible to minimize interference between beam patterns of at least two sound beams by making relative phases of the at least two sound beams be different.

For example, by controlling a phase of each of the at least two sound beams to be combined based on a beam pattern, for example, a beam shape, it is possible to minimize degradation of a main lobe or a side lobe after the combination.

For example, in the case of two sound beams $P_1$, and $P_2$ facing different directions, $$P(\theta)=e^{j\phi}P_1(\theta)-e^{-j\phi}P_2(\theta).$$

Here, an optimal phase value $\phi$ may be determined based on a criterion of minimizing a far-field sound pressure compared to a sound pressure in both ear positions of each of at least one listener. An optimization scheme of acquiring the optimal phase value will be described with reference to FIG. 6.

To generate at least two sound beams maximizing a far-field sound pressure attenuation with respect to a source signal, a variety of information associated with a sound transfer function may be used.

Information associated with the sound transfer function may include information associated with the sound transfer function from each of speakers of a speaker array to a position of at least one listener, and information associated with the sound transfer function from each of the speakers of the speaker array to a far-field position.

Information associated with the sound transfer function from each of speakers of the speaker array to the position of the at least one listener may be expressed by information $H_{ear}$ associated with the sound pressure from each speaker to the position of the at least one listener.

Information associated with the sound transfer function from each of the speakers of the speaker array to the far-field position may be expressed by information $H_{far}$ associated with the sound pressure from each speaker to the far-field position.

A spatial sound energy distribution adjusting apparatus and method according to one or more embodiments may attenuate a far-field sound pressure while generating a plurality of separate sound beams and thus, may be applicable to a case where at least two sound beams are focused with respect to a plurality of listeners.

A spatial sound energy distribution adjusting method will be described with reference to FIG. 4A through FIG. 7.

Figure 4A:
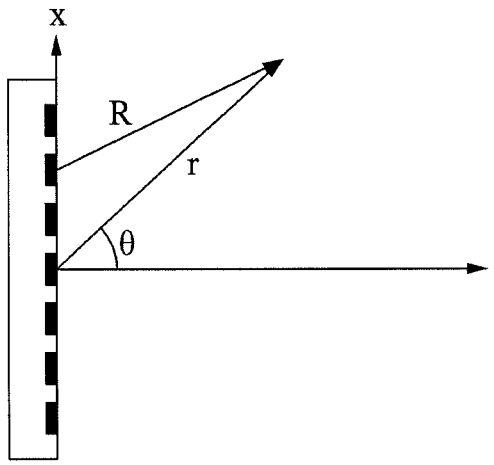
FIG. 4A and FIG. 4B illustrate a coordinates system between a speaker array and a listener according to one or more embodiments.
Figure 4B:
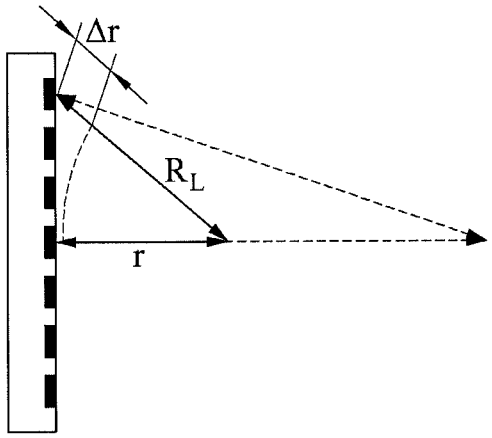
Figure 5:
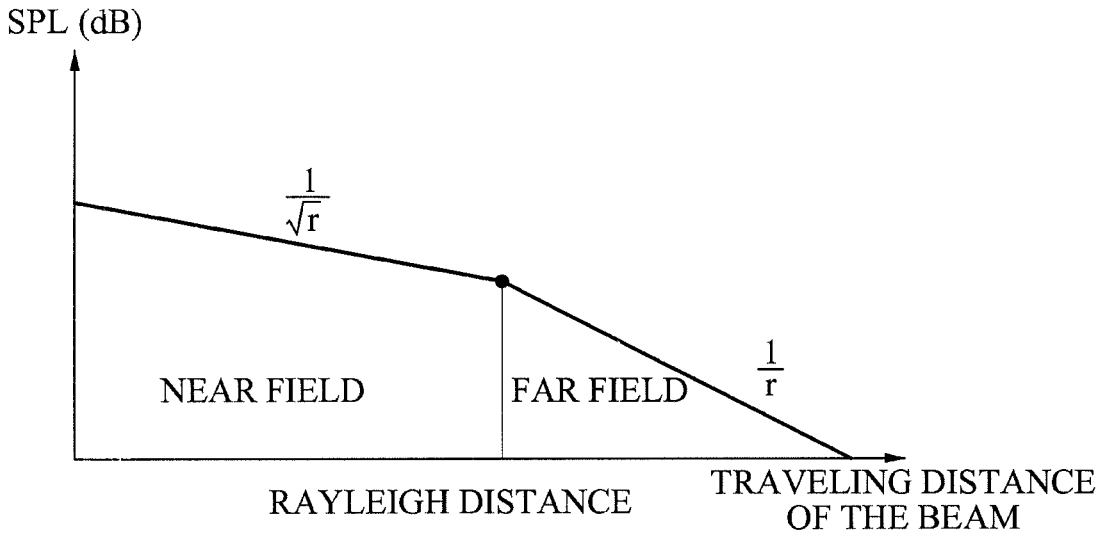
FIG. 5 illustrates a near-field characteristic and a far-field characteristic based on a propagation distance of a sound beam according to one or more embodiments.

FIG. 4A and FIG. 4B illustrate a coordinates system between a speaker array and a listener according to one or more embodiments, and FIG. 5 illustrates a near-field characteristic and a far-field characteristic based on a propagation distance of a sound beam according to one or more embodiments.

A distance attenuation rate of a sound beam generated using the speaker array may vary depending on a propagation distance of the sound beam. In general, when a distance from the speaker array to the listener is sufficiently greater than a size of the speaker array, the sound pressure of the sound beam may decrease in inverse proportion to the distance, which is the same as a general monopole sound source.

Referring to FIG. 4A, when a distance between a listener spaced apart from a center of the speaker array at angle θ by distance r, and a speaker spaced apart from the center of the speaker array by distance x is R, the distance R may be approximated as expressed by Equation 1. A corresponding sound pressure P(r, θ) may be expressed by Equation 2.

$$R = \sqrt{r^2 + x^2 - 2xr\sin\theta} \simeq r - x\sin\theta \quad \text{[Equation 1]}$$

$$p(r, \theta) = \int \frac{q(x)}{R} e^{jkR} dx \simeq \frac{A}{r} e^{jkr} \int q(x) e^{-jk\sin\theta x} dx \quad \text{[Equation 2]}$$

In Equation 2, q(x) denotes a control signal of the speaker in the position x, and kR or kr denotes a phase.

Using a function of a distance and a direction, the sound pressure P(r, θ) may be expressed by Equation 3.

$$p(r, \theta) \propto \frac{b(\theta)}{r} \quad \text{[Equation 3]}$$

In this example, the sound pressure in the beam center portion may decrease in inverse proportion to the distance r, and the beam pattern b(θ) with respect to the direction may be constant at all times regardless of the distance r.

However, when the listener is positioned to be closer to the speaker array, the relationship of Equation 3 may not be achieved. Interference of sound waves in each speaker may occur in a further complex form. This is referred to as a near-field area. Generally, the distance attenuation may slowly occur in the near-field area.

In Equation 2, it is assumed that the listener is positioned in the near field in a front direction (θ=0).

When the listener is positioned to be close to the speaker array, the distance R between the listener and the speaker array may quickly vary for each speaker position. Accordingly, the phase kR or Kr of Equation 2 may also quickly vary.

In this example, a near-field sound pressure may be approximated using a stationary phase approximation, as given by Equation 4.

$$p(r, \theta) \propto \sqrt{\frac{2\pi}{k}} e^{j\pi/4} \left( \frac{e^{jkr}}{\sqrt{r}} \right) \quad \text{[Equation 4]}$$

In Equation 4, k corresponds to 2×π/λ.

When expressing, as an equation, an example of a beam pattern of which the near-field sound pressure is slowly attenuated in proportion to a square root of a distance, the far-field sound pressure and the near-field sound pressure may decrease at different rates as shown in FIG. 5. Hereinafter, Rayleigh distance will be described with reference to FIG. 4B and FIG. 5.

One of methods of separating a far field and a near field may include calculating Rayleigh distance ($r_c$).

Rayleigh distance ($r_c$) may be defined as a distance in which a difference between a distance $R_L$ from an outermost of the speaker array to the listener positioned in the center and the distance r from the array center corresponds to a ¼ wavelength, and may be expressed by Equation 5.

$$\Delta r_{c,} = R_L - r_c = \frac{\lambda}{4} \quad \text{[Equation 5]}$$

In Equation 5, since $R_L = \sqrt{r_c^2 + (L/2)^2}$, Rayleigh distance ($r_c$) in a case where all the speakers are similarly excited may increase according to an increase in an aperture size L, and may decrease according to an increase in a wavelength, that is, according to a decrease in a frequency.

When the listener is positioned in a front direction from the speaker array by at least the Rayleigh distance, the distance difference from each speaker of the speaker array to the listener may be insignificantly small compared to the wavelength. Even though the listener moves further away, the distance difference may barely occur. Accordingly, a sound beam characteristic may not vary based on a distance and be attenuated at 1/r.

To further decrease the reflection by the reflected surface, there may be a need to decrease the far-field sound pressure attenuation rate. However, as described above, the sound pressure in the position after the Rayleigh distance may be attenuated at 1/r and thus, it may be impossible to physically control the attenuation rate in this area.

When decreasing 1/r in a further near distance, a relatively low far-field sound pressure may be acquired even though the sound pressure is the same in the listener position. Accordingly, it is possible to configure a sound beam having a short Rayleigh distance.

To further decrease the Rayleigh distance, it is possible to use a method of compensating for a phase difference between a signal generated in an outermost of a speaker array and a signal generated in a center of the speaker array by adjusting a delay of a signal input into each speaker of the speaker array.

By compensating for a delay according to the actual distance difference in the listener position of FIG. 4B using signal processing, the sound beam may demonstrate the same behavior as in a far field in the listener position.

Since the above delay compensation may cause accurate constructive interference against the sound pressure of each speaker in the listener position, the sound pressure may increase in the listener position and thus, the far-field sound pressure attenuation rate may relatively increase.

When compensating for the distance difference Δr with respect to the listener positioned in a front direction (θ=0), a speaker control function q may be expressed by Equation 6.

$$q(x) = e^{-jk\Delta r} = e^{-jk\left(\sqrt{r^2+x^2}-r\right)} \quad \text{[Equation 6]}$$

When the speaker control function q is set as above, the sound pressure by the speaker array in the near field r may be similar to an integration equation with respect to the far-field sound pressure.

In this example, sound waves coming from all the speakers may be configured to have the same phase when reaching the listener, and to have a relatively narrow beam width in the near field.

However, as described above with reference to FIG. 2B, in a high frequency band having a relatively narrow beam width, a beam having a width less than a head size of the listener may be generated. Accordingly, the sound pressure in both ear positions of the listener may decrease.

In this example, the far-field sound pressure attenuation may occur from a near field further away. However, the sound pressure in the listener position may also decrease and thus, it may be impossible to sufficiently generate the sound pressure difference.

Conversely, when increasing the beam width to maintain the sound pressure at both ear positions of the listener, a Rayleigh distance may increase whereby the beam width may decrease in a far field further away. Accordingly, the affect of reflected waves may increase. According to one or more embodiments, there may be provided a method of generating at least two sound beams maximizing the far-field sound pressure attenuation with respect to a source signal.

Figure 6:
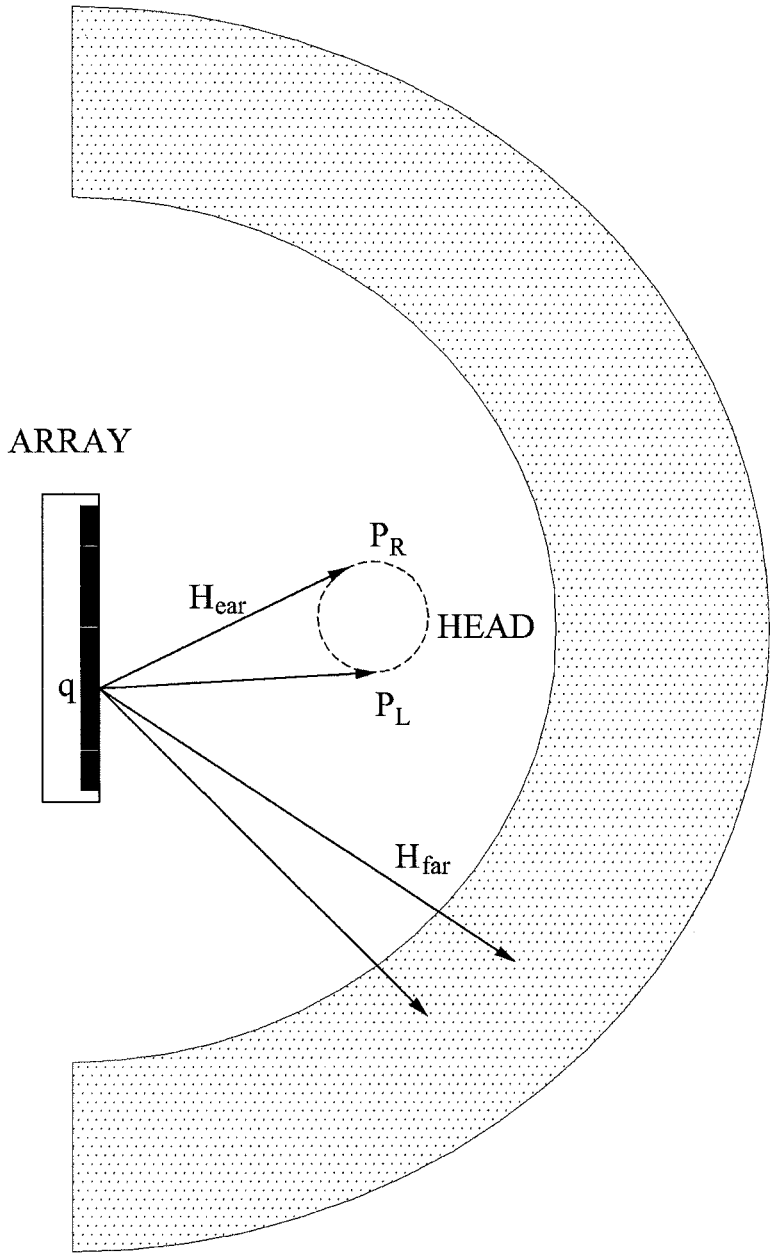
FIG. 6 illustrates variables defined for constrained optimization according to one or more embodiments.

FIG. 6 illustrates variables defined for constrained optimization according to one or more embodiments.

Referring to FIG. 6, when acquiring an optimal phase value, compared to a method of initially calculating a beam pattern of a sound beam and then minimizing artifact, a method of designing an optimal separate beam based on both a beam pattern and a phase may achieve a relatively high performance.

Accordingly, a constraint criterion may be assigned so that the sound pressure corresponding to a predetermined phase difference may occur in both ear positions of a listener. Next, a speaker excitation function q minimizing the far-field sound pressure and a corresponding beam pattern may be obtained.

The sound pressure occurring in both ears of the listener may have the same magnitude, however, may have a different relative phase. Here, when the sound pressure that is to occur in a left ear and a right ear of the listener is expressed by $P_L$ and $P_R$, the sound pressure in both ears of the listener may be expressed by Equation 7.

$$P_L=e^{j\phi}\ P_R=e^{-j\phi} \quad \text{[Equation 7]}$$

When using a vector form, the sound pressure may be expressed by Equation 8.

$$P_{target} = \begin{bmatrix} e^{j\phi} \\ e^{-j\phi} \end{bmatrix} \quad \text{[Equation 8]}$$

When a sound transfer function from each speaker constituting the speaker array to both ear positions of the listener is $H_{ear}$, the sound pressure occurring in both ear positions due to the speaker array driven by a control signal vector q may be expressed by $H_{ear}q=P_{target}$.

Similarly, when a sound transfer function from each speaker constituting the speaker array to the far field position is $H_{far}$, the far-field sound pressure may be expressed by $P_{far}=H_{far}q$.

While maintaining the above sound pressure in the listener position, the far-field sound pressure may need to be minimized. Accordingly, the constrained optimization may be defined as given by Equation 9.

$$arg\ \mathrm{Min}[\|H_{far}q\|^2] \text{ subject to } H_{ear}q=p_{target} \quad \text{[Equation 9]}$$

The above constrained optimization may be calculated using Capon's minimum variance estimator. A mathematical solution thereof may be expressed by Equation 10.

$$q=R_{far}^{-1}H^H_{ear}(H_{ear}R_{far}^{-1}H^H_{ear})^{-1}P_{target}$$

$$R_{far}=H^H_{far}H_{far} \quad \text{[Equation 10]}$$

In Equation 10, $H_{ear}$ denotes the sound transfer function from each speaker constituting the speaker array to both ear positions of the listener, $H_{far}$ denotes the sound transfer function from each speaker constituting the speaker array to the far field position, and the subscript H denotes a Hermitian conjugate.

Since an optimal phase value that needs to occur in an ear position of the listener is not arbitrarily determined, Equation 10 may be calculated with respect to a plurality of phase values and then, a phase value having a minimum far-field sound pressure may be selected.

The spatial sound energy distribution adjusting method may be widely applicable.

When at least two sound beams are to be focused with respect to a plurality of listeners, target function $P_{target}$ of Equation 8 may be set with respect to a plurality of points. Accordingly, it is possible to attenuate the far-field sound pressure while generating at least two sound beams to a position of each user.

Figure 7:
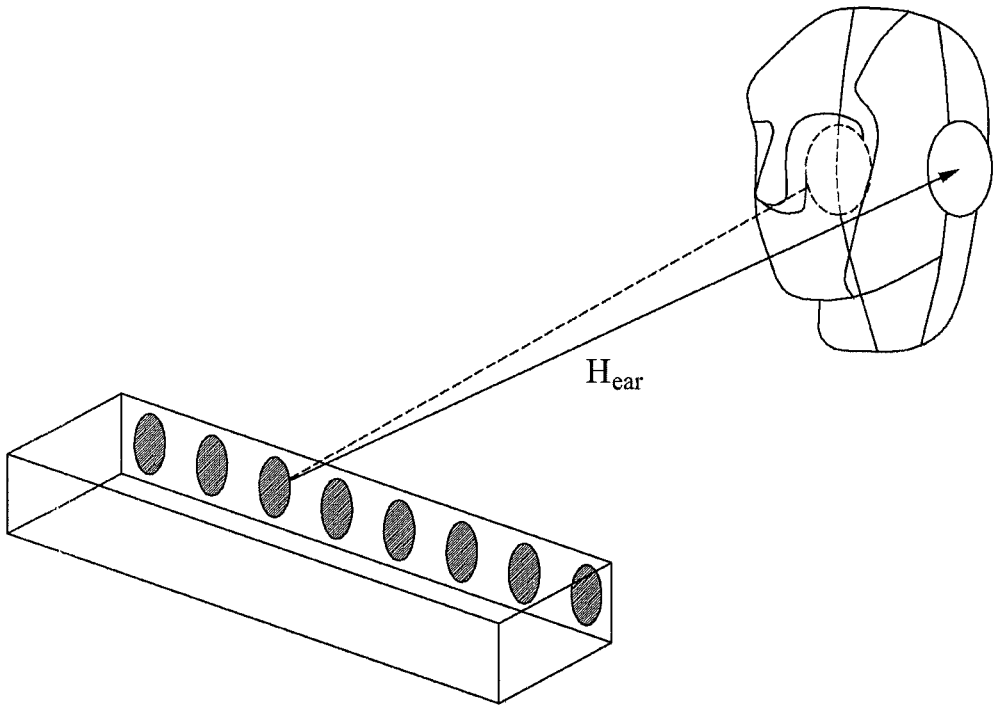
FIG. 7 illustrates a head-related transfer function (HRTF) of a loud speaker constituting a speaker array according to one or more embodiments.

FIG. 7 illustrates a head-related transfer function (HRTF) of a loud speaker constituting a speaker array according to one or more embodiments.

The sound transfer function of FIG. 6 may be expressed using a sound pressure relationship, for example, $H_{ear}$, between each speaker constituting the speaker array and both ear positions of a listener, and a sound pressure relationship, for example, $H_{far}$, between each speaker and the far-field position.

Measurement may be performed using a microphone with respect to ear positions of the listener on a free field, or may be configured by modeling a sound source such as a monopole and the like.

However, in the above case, scattering effect occurring due to a head of the listener may not be considered. Accordingly, by employing a dummy head to represent the sound pressure in ear positions of the listener as shown in FIG. 7, it is possible to decrease the far-field sound pressure while enhancing the actual sound pressure in the ear positions of the listener.

A transfer function between the sound source generating a sound and a signal flowing into an ear of the listener is referred to as an HRTF.

According to one or more embodiments, using an HRTF database between each speaker constituting the speaker array and the dummy head, it is possible to maximize the sound pressure in ear positions of the listener and to minimize the sound pressure in the far-field position.

Maximization of the sound pressure of the listener and minimization of the sound pressure in the far-field position may be achieved by substituting the near-field transfer function used for the constrained optimization with the HRTF.

When using the HRTF, it is possible to maximize the sound pressure in the listener position based on various types of characteristics such as scattering occurring due to the listener head. Accordingly, compared to optimizing of the sound pressure to a free-field state where the dummy head is absent, it is possible to obtain the enhanced performance.

The spatial sound energy distribution adjusting method according to the above-described embodiments may be recorded in non-transitory computer-readable media including computer readable instructions such as a computer program to implement various operations by executing computer readable instructions to control one or more processors, which are part of a general purpose computer, a computing device, a computer system, or a network. The media may also have recorded thereon, alone or in combination with the computer readable instructions, data files, data structures, and the like. The computer readable instructions recorded on the media may be those specially designed and constructed for the purposes of the embodiments, or they may be of the kind well-known and available to those having skill in the computer software arts. The computer-readable media may also be embodied in at least one application specific integrated circuit (ASIC) or Field Programmable Gate Array (FPGA), which executes (processes like a processor) computer readable instructions. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform computer readable instructions, such as read-only memory (ROM), random access memory (RAM), flash memory, and the like. Examples of program instructions include both machine code, such as produced by a compiler, and files containing higher level code that may be executed by the computer using an interpreter. The described hardware deviceS may be configured to act as one or more software modules in order to perform the operations of the above-described embodiments, or vice versa. Another example of media may also be a distributed network, so that the computer readable instructions are stored and executed in a distributed fashion.

Figure 8:
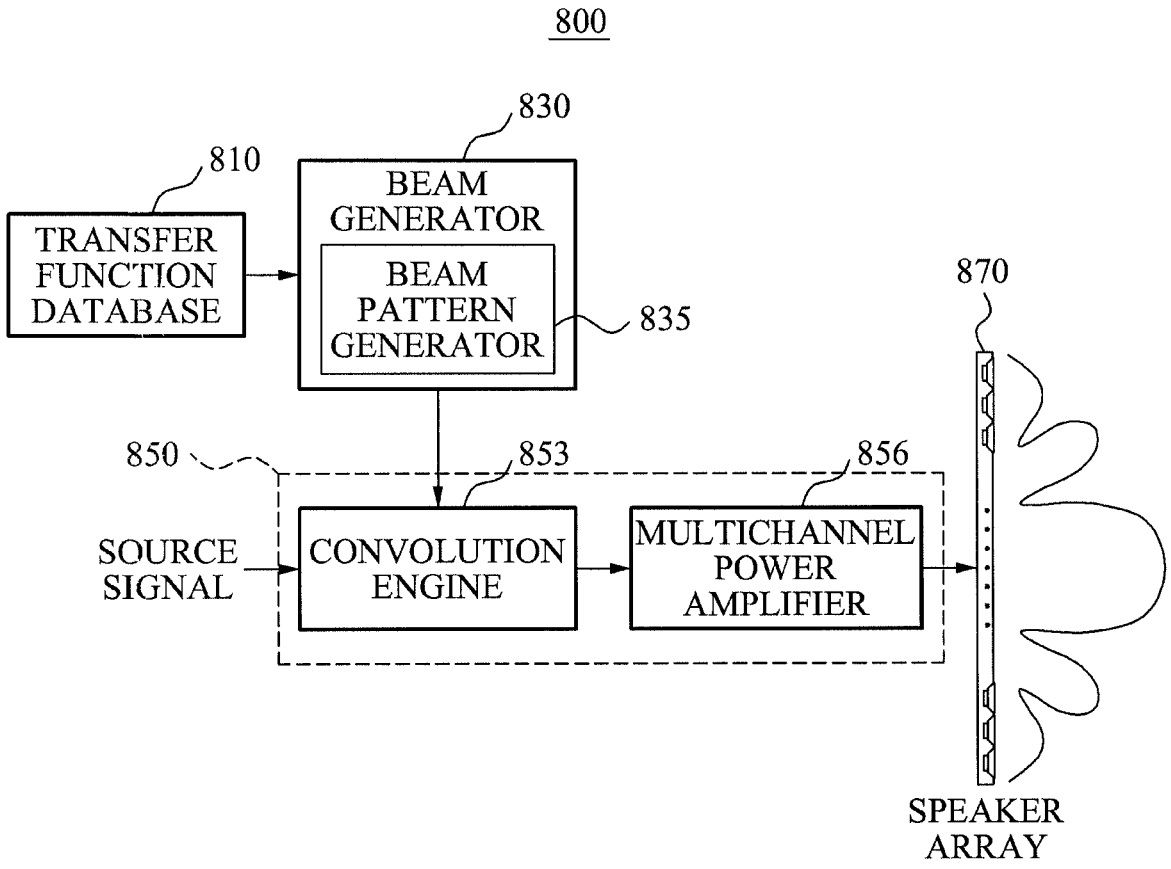
FIG. 8 illustrates an apparatus for adjusting a distribution of spatial sound energy according to one or more embodiments.

FIG. 8 illustrates an apparatus 800 for adjusting a distribution of spatial sound energy according to one or more embodiments.

The apparatus 800 may include a beam generator 830, a convolution calculator 850, and a speaker array 870. The apparatus 800 may further include a transfer function database 810.

The transfer function database 810 may store information associated with a sound transfer function from each of speakers of the speaker array 870 to a position of at least one listener, and information associated with the sound transfer function from each of the speakers of the speaker array 870 to a far-field position.

The transfer function database 810 may be, for example, an HRTF database.

The beam generator 830 may generate at least two sound beams maximizing a far-field sound pressure attenuation with respect to a source signal, in order to form a personal sound zone in the position of at least one listener.

The beam generator 830 may include a beam pattern generator 835 to generate beam patterns of the at least two sound beams based on information stored in the transfer function database 810.

The beam pattern generator 835 may generate the at least two sound beams by making relative phases of the at least two sound beams to be different, to minimize interference between the beam patterns of the at least two sound beams.

The convolution calculator 850 may generate a multichannel signal by performing convolution of the at least two sound beams.

The convolution calculator 850 may include a convolution engine 853 and a multichannel power amplifier 856.

Various embodiments of the convolution calculator 850 will be further described with reference to FIG. 9A through FIG. 9C.

The speaker array 870 may output the multichannel signal via each of speakers constituting the speaker array 870.

Figure 9A:
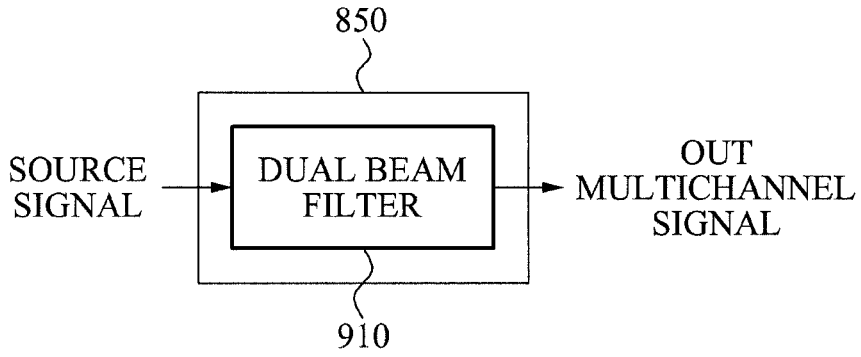
FIG. 9A through 9C illustrate one or more embodiments of a convolution calculator of FIG. 8.
Figure 9B:
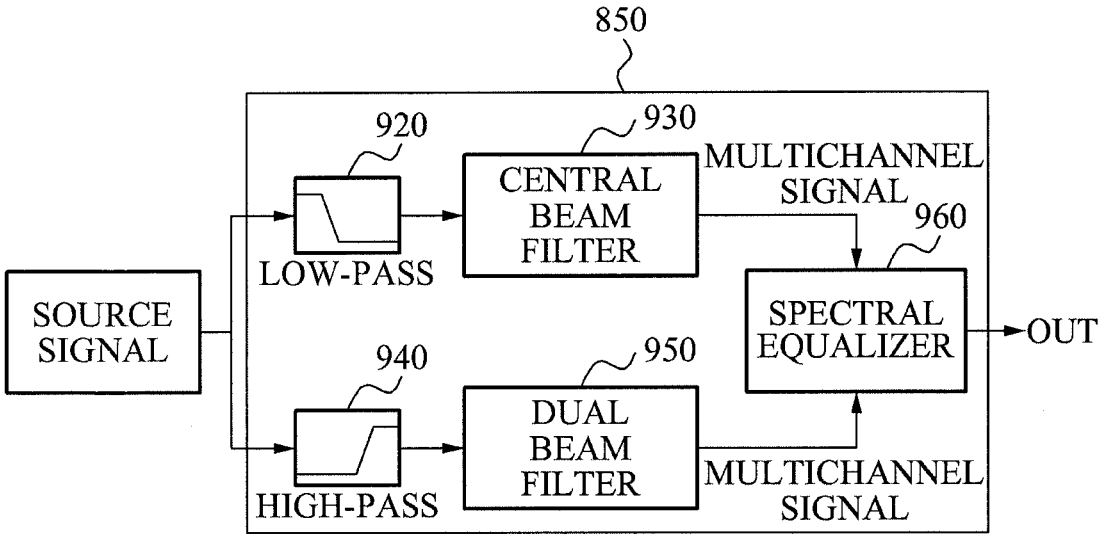
Figure 9C:
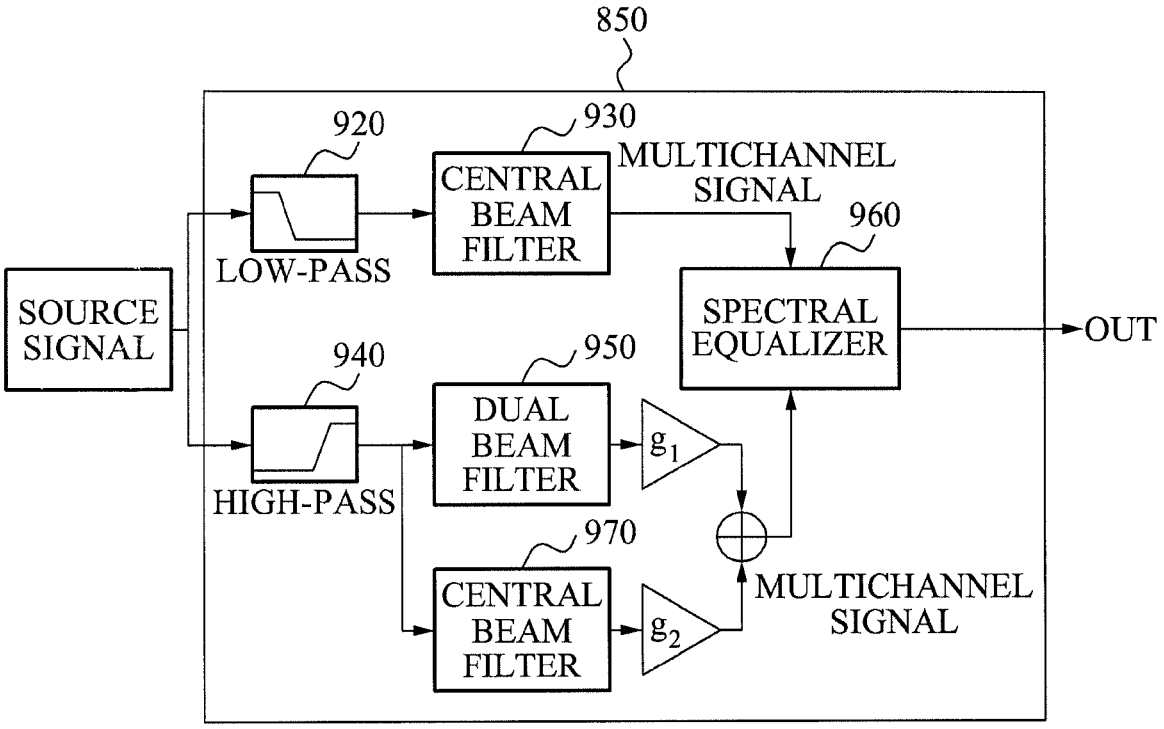

FIG. 9A through FIG. 9C illustrate one or more embodiments of the convolution calculator 850 of FIG. 8.

Referring to FIG. 9A, the convolution calculator 850 may generate the multichannel signal by performing convolution of a source signal to patterns of sound beams using, for example, a dual beam filter 910.

Referring to FIG. 9B, the convolution calculator 850 may apply different beam patterns by separating the source signal into a sound source of a low frequency band and a sound source of a high frequency band based on a frequency band.

The sound source of the low frequency band may be connected to a central beam filter 930 via a low pass filter 920. The sound source of the high frequency band may be connected to a dual beam filter 950 via a high pass filter 940.

The convolution calculator 850 may generate at least two multichannel signals by performing convolution of source signals applied with the different beam patterns using the central beam filter 930 and the dual beam filter 950.

The convolution calculator 850 may further include a spectral equalizer 960.

The spectral equalizer 960 may adjust a frequency distribution of the at least two multichannel signals so that the at least two multichannel signals may not be separately heard in the position of the at least one listener.

Referring to FIG. 9C, the convolution calculator 850 may further include a central beam filter 970 to be in parallel with the high pass filter 940 in the convolution calculator 850 of FIG. 9B.

Accordingly, the convolution calculator 850 may mix a sound beam of an intermediate frequency band with the sound source of the high frequency band.

The convolution calculator 850 may generate the at least two multichannel signals by mixing the sound beam of the intermediate frequency band with the sound source of the high frequency band based on a distance from the at least one listener and a frequency, and by performing convolution of the at least two sound beams.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. An operating method of an audio apparatus including at least one processor and a speaker array to form a personal sound zone in a position of at least one listener of the audio apparatus, the method comprising:

generating, via the at least one processor, at least two sound beams maximizing a far-field sound pressure attenuation with respect to a source signal, based on information associated with a sound transfer function;

generating, via the at least one processor, a multichannel signal by performing convolution of the at least two sound beams; and outputting, via the speaker array, the multichannel signal.

2. The method of claim 1, further comprising:

storing information associated with the sound transfer function from each of speakers of a speaker array to the position of the at least one listener, and information associated with the sound transfer function from each of the speakers of the speaker array to a far-field position.

3. The method of claim 1, wherein the generating comprises generating the at least two sound beams so that beam patterns of the at least two sound beams have a relatively high sound pressure in the position of the at least one listener compared to a surrounding position of the at least one listener.

4. The method of claim 1, wherein the generating comprises generating the at least two sound beams to minimize interference between beam patterns of the at least two sound beams that are focused on both ear positions of each of the at least one listener, based on information associated with the sound transfer function.

5. The method of claim 4, wherein the generating of the at least two sound beams to minimize the interference comprises generating the at least two sound beams by making relative phases of the at least two sound beams be different, to minimize the interference between the beam patterns of the at least two sound beams.

6. The method of claim 4, further comprising:

acquiring an optimal phase value using the beam patterns of the at least two sound beams.

7. The method of claim 6, wherein the acquiring comprises:

assigning, to the beam patterns of the at least two sound beams, a constraint criterion for detecting the optimal phase value;

acquiring a speaker excitation function minimizing a sound pressure in a far-field position, using the beam patterns assigned with the constraint criterion; and acquiring the optimal phase value using the speaker excitation function.

8. The method of claim 7, wherein the constraint criterion minimizes a far-field sound pressure compared to a sound pressure in both ear positions of each of the at least one listener with respect to each of the beam patterns of the at least two sound beams.

9. The method of claim 7, wherein the acquiring of the optimal phase value using the speaker excitation function comprises acquiring, as the optimal phase value, a phase value having a minimum far-field sound pressure among a plurality of phase values satisfying the speaker excitation function.

10. At least one non-transitory computer-readable medium storing computer readable instruction to control at least one processor to implement the method of claim 1.

11. The method of claim 1, wherein two sound beams are generated for the position of each listener.

12. The method of claim 1, wherein the far-field sound pressure is attenuated while generating a plurality of separate sound beams for a plurality of listeners.

13. An apparatus for adjusting a distribution of spatial sound energy to form a personal sound zone, the apparatus comprising:

a beam generator to generate at least two sound beams maximizing a far-field sound pressure attenuation with respect to a source signal, in order to form a personal sound zone in the position of at least one listener;

a convolution calculator to generate a multichannel signal by performing convolution of the at least two sound beams using at least one processor; and a speaker array unit to output the multichannel signal via a speaker array.

14. The apparatus of claim 13, further comprising:

a transfer function database to store information associated with the sound transfer function from each of speakers of the speaker array to the position of the at least one listener, and information associated with the sound transfer function from each of the speakers of the speaker array to a far-field position.

15. The apparatus of claim 14, wherein the beam generator comprises:

a beam pattern generator to generate beam patterns of the at least two sound beams based on information stored in the transfer function database.

16. The apparatus of claim 15, wherein the beam pattern generator generates, based on information stored in the transfer function database, the patterns of the at least two sound beams that are focused on both ear positions of each of the at least one listener to maximize the far-field sound pressure attenuation.

17. The apparatus of claim 13, wherein the beam pattern generator generates the at least two sound beams by making relative phases of the at least two sound beams be different, to minimize interference between the beam patterns of the at least two sound beams.

18. The apparatus of claim 15, wherein the convolution calculator generates the multichannel signal by performing convolution of the beam patterns of the at least two sound beams in real time.

19. The apparatus of claim 15, wherein the convolution calculator generates at least two multichannel signals by separating the source signal into a sound signal of a low frequency band and a sound source of a high frequency band based on a frequency band, by applying different beam patterns to the separated sound signals, and by performing convolution of the sound signals applied with the different beam patterns.

20. The apparatus of claim 19, wherein the convolution calculator generates the at least two multichannel signals by mixing a sound beam of an intermediate frequency band with the sound source of the high frequency band based on a distance from the at least one listener and a frequency, and by performing convolution of the at least two sound beams.

21. The apparatus of claim 18, wherein the convolution calculator further comprises:

a spectral equalizer to adjust a frequency distribution of at least two multichannel signals so that the at least two multichannel signals are not separately heard in the position of the at least one listener.

22. The apparatus of claim 13, wherein the position of the at least one listener corresponds to either both ear positions of a single listener or positions of a plurality of listeners.

23. The apparatus of claim 13, wherein two sound beams are generated for the position of each listener.

24. The apparatus of claim 13, wherein the far-field sound pressure is attenuated while generating a plurality of separate sound beams for a plurality of listeners.

* * * * *